United States Patent [19]

Hanson

[11] Patent Number: 4,519,755

[45] Date of Patent: May 28, 1985

[54] GEROTOR VACUUM PUMP

[75] Inventor: David E. Hanson, Hoffman Estates, Ill.

[73] Assignee: Sargent-Welch Scientific Company, Skokie, Ill.

[21] Appl. No.: 572,140

[22] Filed: Jan. 23, 1984

Related U.S. Application Data

[63] Continuation of Ser. No. 470,084, Mar. 3, 1983, abandoned, which is a continuation of Ser. No. 148,453, May 9, 1980, abandoned.

[51] Int. Cl.[3] ..... F04C 18/10; F04C 25/02; F04C 27/02

[52] U.S. Cl. ..... 418/9; 418/100; 418/171; 417/32

[58] Field of Search ..... 418/9, 96–100, 418/166, 171; 417/32

[56] References Cited

U.S. PATENT DOCUMENTS

| | | | |
|---|---|---|---|
| 1,389,189 | 8/1921 | Feuerheerd | 418/166 |
| 1,505,707 | 8/1924 | Hill | 418/171 |
| 1,513,659 | 10/1924 | Wardwell | 418/171 |
| 1,682,564 | 8/1928 | Hill | 418/97 |
| 1,773,211 | 8/1930 | Wilsey | 418/9 |
| 2,830,542 | 4/1958 | Erickson et al. | 418/171 |
| 3,040,973 | 6/1962 | Wessling | 418/100 |
| 3,157,350 | 11/1964 | Fraser | 418/171 |
| 3,272,130 | 9/1966 | Mosbacher | 418/171 |
| 3,509,825 | 5/1970 | Sorensen | 417/44 |
| 3,838,950 | 10/1974 | Andriulis | 418/96 |
| 4,268,224 | 5/1981 | Breuer et al. | 417/32 |

FOREIGN PATENT DOCUMENTS

| | | | |
|---|---|---|---|
| 225015 | 4/1959 | Australia | 417/32 |
| 233265 | 5/1925 | United Kingdom . | |
| 1004119 | 9/1965 | United Kingdom . | |

*Primary Examiner*—John J. Vrablik

*Attorney, Agent, or Firm*—Lockwood, Alex, Fitzgibbon & Cummings

[57] ABSTRACT

A unique gerotor-type pump is disclosed for pumping gases. The pump has an inner gear-type rotor mounted within and rotating off-center with respect to an outer gear-type rotor ring, about a parallel axis. Surfaces of the teeth of the inner rotor are in continuous contact with the outer rotor to define at least one pumping chamber which alternately expands and contracts as the inner and outer rotors turn. An elongated inlet port is positioned to communicate with the pumping chamber during a substantial portion of the cycle when the pumping chamber is expanding, (the intake cycle) and an outlet port is positioned to communicate with the pumping chamber only just prior to and at the end of the contraction or exhaust cycle. Oil for sealing and lubricating between moving parts of the pump is provided by employing differential pressure created by the pump's own operation to draw oil through passageways which communicate between an oil reservoir and the pumping chamber.

18 Claims, 13 Drawing Figures

Fig. 9
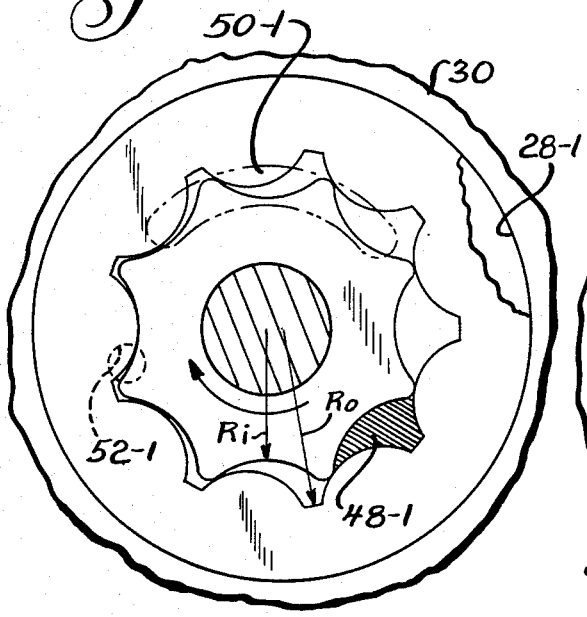
Fig. 7
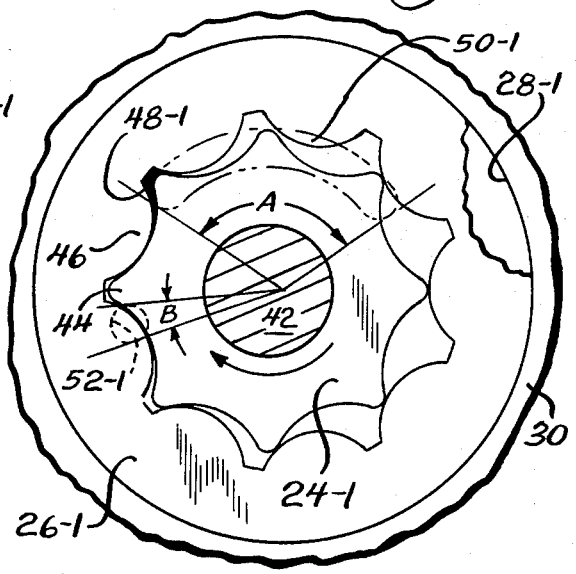
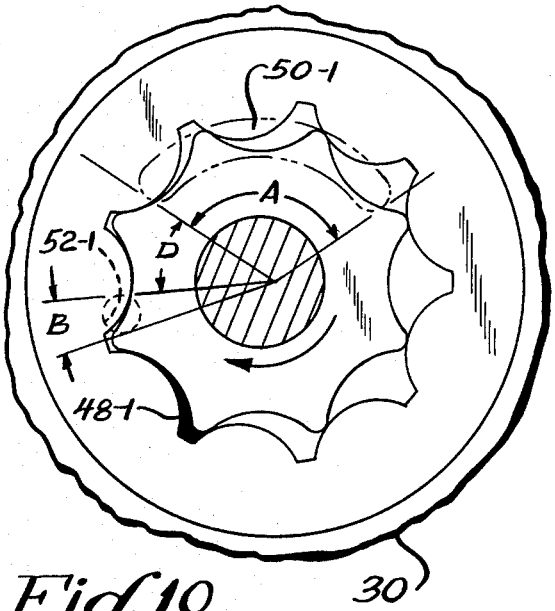
Fig. 10
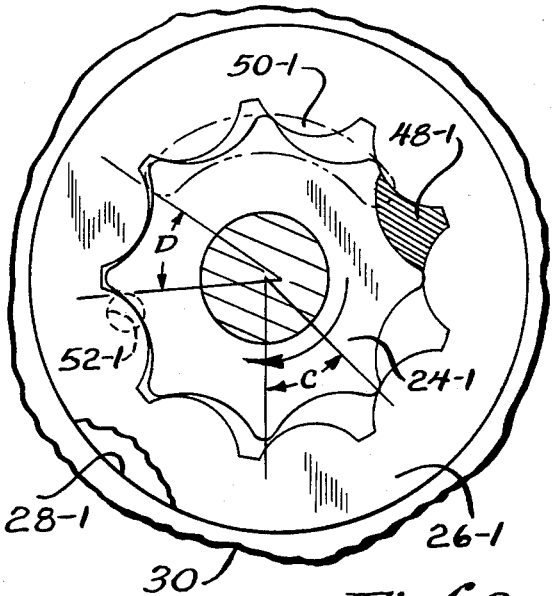
Fig. 8

GEROTOR VACUUM PUMP

This application is a continuation, of application Ser. No. 470,084, filed Mar. 3, 1983, now abandoned, which is a continuation of application Ser. No. 148,453, filed May 9, 1980, now abandoned.

The present invention relates in general to pumps for pumping gases and more specifically to vacuum pumps and the like.

Pumps for compressing or transferring gases, such as vacuum pumps, are used in a wide variety of industrial and laboratory applications. Depending on the particular application, typical features desired in a vacuum pump include a long operating life or durability, high pump capacity to transfer relatively large quantities of gas in a short time and the capability to pump down to pressure levels of less than or equal to about $10^{-3}$ Torr. In industrial applications, it is especially desirable that the pump be resistant to excessive wear and blockage due to contaminants such as dirt, water or water vapor in the gas being pumped. For example, vacuum pumps are often used to evacuate refrigeration systems before freon or other coolant is added. In this type of application, the gas being pumped may carry water droplets, water vapor or dust, as well as other contaminants which may impair the effectiveness of lubricating oil in the pump and result in increased wear and potential leakage, especially at the pressure levels set forth above.

One type of vacuum pump which has been used in such industrial applications is a rotary vane pump, such as the one illustrated in U.S. Pat. No. 3,782,868, granted Jan. 1, 1974. Typically, rotary vane pumps employ an off-center rotor within a cylindrical chamber. The rotor usually has a pair of radially slidable vanes which are in continuous contact with the surface of the chamber, to define a pumping chamber between the rotor and the cylindrical chamber wall, that alternately expands and contracts as the rotor turns. Although such pumps generally have worked satisfactorily, the continuous high-speed wear between the rotary vanes and chamber wall require continuous and generous lubrication, and may be subject to wear from contaminants entering the oil and reducing its lubrication efficiency.

Another type of pump which has been used for pumping at pressure levels described here is commonly referred to as a rotary piston pump. That pump employs an eccentrically mounted element which turns with a base and carries an oscillating vane. Because of the eccentric mounting, vibration levels may be sufficient to have detrimental effects in the drive components and thus reduce the useful life of the pump, as well as being noisy and difficult to attach to a rigid system.

Another type of pump heretofore known, but not for pumping gases, is referred to as a gerotor pump. This type of pump employs an inner gear-type rotor which rotates within an outer gear-type ring. The teeth of the inner rotor are in continuous contact with the surface of the outer rotor to define a pumping chamber between each pair of teeth, which chamber alternately expands and contracts as the rotors turn. Gerotor pumps, as such, are well known and have been specifically used for pumping oils, hydraulic fluids and other liquids. As compared to other pumps, e.g., the rotary vane pump, it has relatively few moving parts, it is easy to fabricate and assemble, and has low differential rotational speed as between the rotors, which reduces wear. However, the gerotor pumps currently available have a variety of shortcomings when used for pumping gases. For instance, gerotor pumps typically depend on the oil or fluid being pumped for lubrication and don't have separate lubrication capability as is required when gas is being pumped. This, combined with the usual inlet and outlet port design for gerotor pumps, permits gas to bypass between moving parts of the pump and prevents the pump from being used to pump gases at low pressures.

Accordingly, it is a general object of the present invention to provide a gerotor-type gas pump which does not suffer from the deficiencies described above.

It is another object of the present invention to provide a gerotor type vacuum pump which has a port design and sufficient lubrication to reduce wear and provide sealing between moving surfaces so as ro permit the pumping of gas at very low pressure.

These and other objects of the present invention are set forth in the following detailed description of the preferred embodiment of the present invention as shown in the attached drawings, of which:

FIG. 1 is a perspective view of a gerotor pump employing the present invention FIG. 2 is an exploded perspective view of the gerotor pump of FIG. 1.

FIG. *2a* is a front elevational view of the center piece of the three-piece pump block shown in FIG. 2.

FIG. *2b* is a horizontal sectional view taken along line *2b–2b* of FIG. *2a*.

FIGS. 7–10 are sequential vertical plan views of assembled gerotor rotor elements illustrating, in part, the operation of the gerotor pump embodying the present invention.

Figures 1, 2, 2A, 2B:
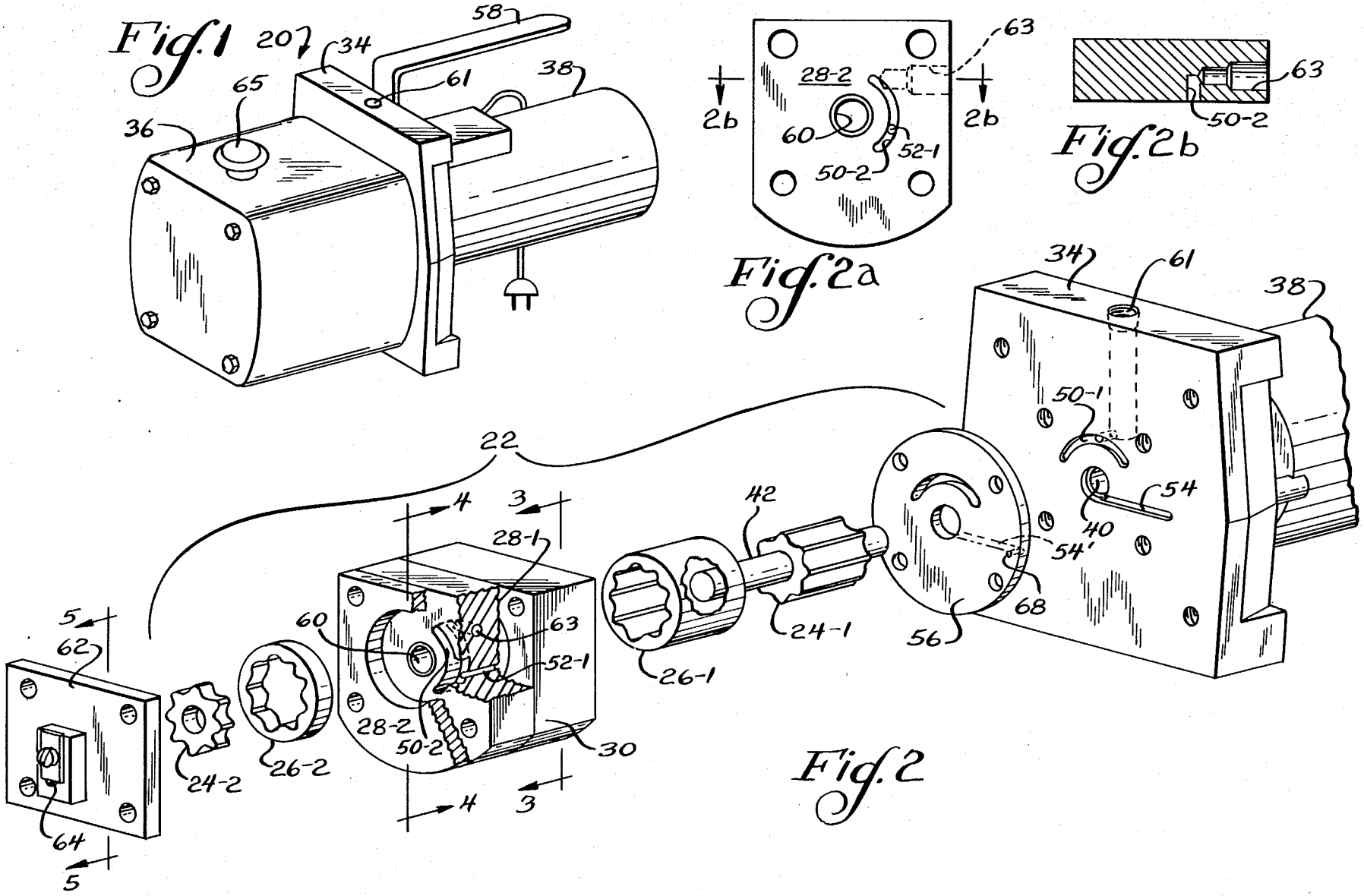

Referring to the drawings for the purpose of illustration only, the present invention is embodied in a two-stage vacuum pump 20 employing a gerotor rotor assembly 22 for pumping gaseous materials and the like. For each pumping stage, the rotor assembly 22 employs an interior gear-type rotor 24 and an outer gear-type rotor ring 26 mounted within one of two axially parallel but off-set rotor chambers 28 in each end of pump block 30. Hereinafter the numeral designations pertaining to the first and second pumping stages shall be respectively followed by the numerals 1 or 2, e.g., rotor chamber 28-1.

The gerotor rotor assembly 22 and pump block 30 are mounted on one side of a mounting plate 34 and within a cover 36. The cover 36 contains an oil bath in which the rotor assembly and block are submerged during operation. The rotor assembly 22 is driven by an electric motor 38 which is attached to the other side of the mounting plate 34, and drives the assembly through a sealed center shaft opening 40.

Referring briefly to FIGS. 7–10, which illustrate the gerotor elements in different rotational positions, it may be seen that the inner rotor 24-1 is mounted on a drive shaft 42 which is off-center within the outer rotor 26-1. As the inner rotor 24-1 is turned by the electric motor 38, via shaft 42, intermeshing of the inner and outer rotor teeth, 44 and 46 respectively, causes the outer rotor also to rotate within the rotor chamber 28-1. The inner rotor 24-1 has one less tooth than the outer rotor 26-1, so that the teeth of the inner rotor are in continuous contact with the surface of the outer rotor and define a pumping chamber 48-1 between each pair of rotor teeth, as shown by the shaded or cross hatched area. As the inner rotor 24-1 rotates, the pumping chamber 48-1 alternately expands and contracts during each revolution of the inner and outer rotors, as shown in sequence in FIGS. 7–10.

In accordance with the present invention, the advantages of the gerotor principle in general may be used for pumping gases and the like, by employing an elongated gas inlet port 50-1 which spans a relatively large angle so as to communicate with each pumping chamber 48-1 during most of the rotational cycle when the chamber is expanding, and a discharge port 52-1, angularly spaced from the inlet port 50-1 spanning a substantially smaller angle B and positioned so as to communicate with the pumping chamber 48-1 only just prior to and/or at the end of the compression (contraction) cycle. It should be noted that the inlet and outlet ports 50-1 and 52-1 are preferably at opposite ends of the rotor set, and the inlet port shown in dashed lines in FIGS. 7–10 is actually in the pump mounting plate 34 (see FIG. 2) and is therefore actually above the surface of the paper. Although not normally part of a plan view, the inlet port is shown in FIGS. 7–10 for the purpose of explanation and to better illustrate the relative angular spacing between the inlet and outlet ports. This may be more clearly understood by referring briefly to FIG. 2, which shows the actual apparatus and inlet and outlet ports in a perspective rather than a plan view.

For lubricating as well as sealing between relative moving parts of the rotor assembly 22, oil is introduced into the pumping chamber 48-1 by using differential pressures created by the rotation of the pump itself. The oil sealing cooperates with the relative shape of and spacing between the inlet and outlet ports to permit the pump to be used for pumping gases at very low pressures. In this aspect of the present invention, oil is drawn into the pumping chamber from the surrounding oil bath through a channel 54 in the mounting plate, or a like channel 54′ in the wear plate 56, which channel communicates between the oil bath at one end and the sealed shaft opening 40 at the other. Suction created during the expansion of the pumping chamber 48-1, draws oil into the shaft area, from the shaft area through a minute space between the rotor element 24-1 and the wear plate 56 to the inlet port 50-1, and into the chamber 48-1. The lubricating oil coats the surfaces of the moving parts and provides a seal between them, permitting the pumping of relatively low pressure levels. In other words, the oil is drawn through the inlet port 50-1 at one end of the pumping chamber 48-1, and gradually moves along the length of the rotor gear 24-1, as the rotor gear is also turning, and exits through the outlet port 52-1 at the other end, thereby following a generally spiral path through the rotor assembly as it lubricates and seals. The flow path through the second pumping stage is similar.

Turning now to a more detailed description of the attached drawings, which show the present invention in its preferred embodiment for the purpose of illustration only, the pump 20 is compact and relatively lightweight, making it especially portable, and ideal for servicing equipment in the field, for example, refrigeration systems and the like. As shown in FIG. 1, the pump 20 has a handle 58 which may be attached, as an example to the mounting plate 34, which permits the pump to be carried about.

The pump is driven by direct connection between the rotor assembly drive shaft 42 and the electric motor 38, through the mounting plate 34. Although different types of motors may be used, a brush type motor, as opposed to a conventional induction motor, is preferred because it permits the use of multiple drive speeds for the pump.

The various elements of a gerotor pump assembly embodying the present invention are best shown in FIG. 2, which depicts a dual or two-stage pump, with two sets, 24-1, 26-1 and 24-2, 26-2, of gerotor pumping elements connected in series to achieve higher pumping efficiency and lower pressure levels. Each set of rotor elements rotate within one of a pair of cylindrical rotor chambers 28-1 and 28-2 provided in the pump block 30. The pump block may be of one piece construction, but a stacking or build-up arrangement of three separate pieces, as shown in FIG. 2, is preferred because it reduces fabrication and machining cost. In this arrangement, a center piece (shown in FIGS. 2*a* and 2*b*) is mounted between two end pieces with bores to form the rotor chambers 28-1 and 28-2. Both of the inner rotors 24-1 and 24-2 are turned by the common drive shaft 42, which extends through shaft opening 60 in the center piece of the pump block between the rotor chambers. The other end of the shaft 42 extends through a bearing (not shown) in shaft opening 40 in the mounting plate 34 to the motor 38.

The rotor elements 24-1, 26-1 and 24-2, 26-2 are mounted within rotor chambers 28-1 and 28-2, respectively, substantially flush with the end surfaces of the pumping block 30, but with sufficient clearance for rotation and oil sealing. Because the mounting plate 34 is preferably made of aluminum, the pump block 30 is preferably spaced from the mounting plate by the steel wear plate, although other wear surface or coatings may be used. The other end of the pump block is closed by a steel end plate 62. The entire assembly of the end plate, pump block, rotor elements and wear plate are secured to the mounting plate 34 by bolts not shown. As noted earlier, this entire assembly is submerged in an oil bath contained within the pump housing 36.

When the pump is operating, gas is drawn from the volume to be evacuated through a conduit or hose attached to an air inlet opening 61 in the mounting plate 34, which communicates with the crescent-shaped elongated curved inlet port 50-1. The wear plate 56 has a matching crescent-shaped opening, to permit the air or other gas that is being pumped to enter the pumping chamber 48-1 defined between the first stage rotor elements 24-1 and 26-1.

FIGS. 7–10 depict the pumping sequence for the first stage pumping chamber 48-1. As the inner rotor 24-1 turns in the illustrated embodiment in a clockwise direction, it drives the outer rotor 26-1, which has one more tooth than the inner rotor, in a clockwise direction at a slightly slower rotational speed than the inner rotor. This is one advantage of a gerotor pump—slow differential rotational speed between the inner rotor 24-1 and the outer rotor 26-1. In FIG. 7, the shaded area, which represents the pumping chamber 48-1, is beginning to expand and draw in gas from the inlet port 50-1. It should be noted that the pumping chamber 48-1 defined between the rotor elements is closed at one end by the wear plate 56 and at the other end by the inside surface of the rotor chamber. The inlet port is shown in dashed lines for purposes of explanation, but as noted earlier, is actually part of the spacer plate and mounting plate, and in actuality is above the level of the paper in the FIG. 7 plan view.

As the pump continues to rotate in a clockwise direction, the pump chamber 48-1, which is beginning to expand when it is first in communication with the leading edge of the inlet port (FIG. 7), has substantially completed the expansion cycle when it passes our of communication with the end edge of the inlet port (FIG. 8). To accommodate this communication during most of the expansion cycle, the elongated inlet port 50-1 is positioned so that its leading edge (in the direction of rotor rotation) is spaced as close as 3° from the position or point at which the contraction or compression cycle is complete, and spans an angle A (FIGS. 7, 10) which is greater than the angle C between adjacent teeth of the inner rotor 24-1. Preferably, the angle A does not exceed the quantity (180° - C./2).

After passing out of communication with the inlet port 50-1, continued rotation of the inner rotor 24-1, causes the pumping chamber 48-1 to contract (FIG. 9) compressing the gas within the chamber. It is only when the chamber is nearly completely contracted, and the volume of gas is almost compressed to its minimum, that the chamber moves into communication with the outlet port 52-1 (FIG. 10). The outlet port is at the opposite end of the rotor chamber 28-1 from the inlet port 50-1, and is preferably spaced (angle D) between 5° and 38° from the inlet port—the smaller the rotor diameter, the larger the angular spacing required. The outlet port 52-1 is automatically smaller than the inlet port 50-1, in that it spans an angle B which is less than the angle C between adjacent inner rotor teeth, and is preferably less than or equal to one-half the angle C, i.e., $\leqq C/2$. The outlet port may be of any desired cross-sectional shape or geometry within the range set forth above, but the illustrated embodiment employs a circular outlet port 52-1. When the pumping chamber comes into communication with the outlet port the compressed gas is forced rapidly into the port which, referring back to FIG. 2, communicates directly with the inlet port 50-2 of the second pumping stage.

By comparing the relative sizes of the rotor elements between stages 1 and 2, it is apparent that stage 1 has a much larger pumping capacity than the second stage of the pump. When larger volumes of gas are being pumped by the first stage than can be handled by the second stage, such as during initial evacuation of a volume of gas, the excess gas is permitted to escape through a bypass port 63 (FIGS. 2*a* and 2*b*) that communicates with the crescent-shaped inlet port 50-2 of the second stage. The bypass port 63, which is drilled or otherwise formed in the center piece of the pump block, is normally closed by a relief valve, for example, a poppet valve of the type shown in FIG. 6, which is set to open under the pressure caused by the pumping of large quantities of gas. After the gas exits from the pump block, it is allowed ro escape into the ambient atmosphere through a standard vent 65 in the housing 36.

Figure 6:
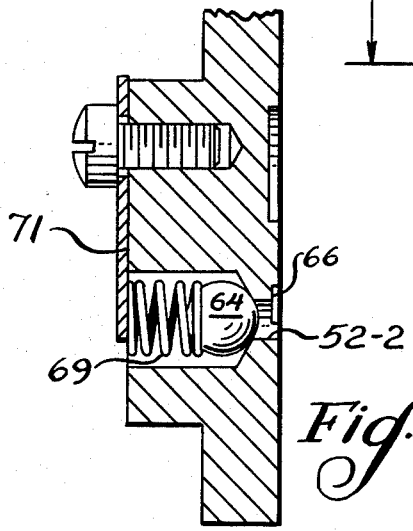
FIG. 6 is a vertical sectional view taken along line 6—6 of FIG. 5.
Figure 5:
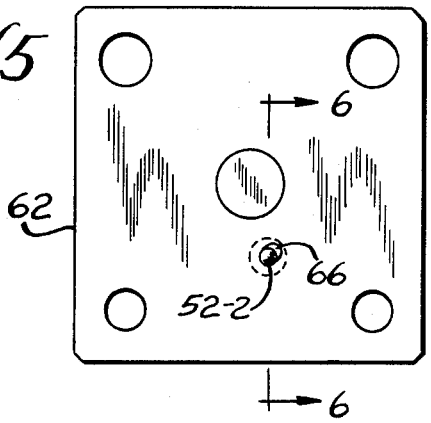
FIG. 5 is an elevational view of the inside surface of the pump end plate, taken along line 5—5 of FIG. 2.

As shown in FIG. 2, the outlet port 52-1 of the first stage communicates directly with the elongated, crescent-shaped inlet port 50-2 for the second pumping stage. The second stage rotor chamber 28-2 is narrower than the first stage, and rotatably receives the second stage outer rotor 26-2 and inner rotor 24-2, which is driven by the common drive shaft 42 extending through pump block 30. The end of the pump block is covered by the end plate 62 which, as best seen in FIGS. 5 and 6, provides the outlet port 52-2 for the second pumping stage. This outlet port, as shown in FIG. 6, is normally closed by a spring loaded poppet valve 64 mounted on the exterior of the end plate. This poppet valve, which may be of a variety of shapes, is held against the port 52-2 in the normally closed position by a coil spring 69 and overlying leaf or spring retainer 71, and serves to prevent gas and lubricating oil from leaking into the pumping chambers. Other types of one-way valves, for example, flapper or reed valves, may also be used without departing from the present invention. Although the outlet port 52-2 in the end plate is circular, it includes a small recessed area 66, on the inside surface of the plate, which extends from the outlet port at an angle to communicate with the pumping chamber 48-2 in the second stage slightly earlier in the compression cycle than the outlet port in the first stage, but still substantially when the compression or contraction cycle is complete. This is understood to permit better exhaust from the second stage when higher vacuum levels or lower gas pressures are being pumped.

Accordingly, after gas enters the second pumping stage inlet 50-2, the operation is substantially the same as the first stage, and the port geometry and location similar. The pumping chamber 48-2 which is defined between the inner rotor 24-2 and outer rotor 26-2, expands substantially completely as it moves past the inlet port 50-2 and then contracts so that it communicates with the outlet port 52-2 in the end plate 62 just prior to and/or the end of the compression cycle. After the initial evacuation of the large quantities of gas, and when there is not sufficient gas remaining at the source to require operation of the intermediate pressure relief valve, all the gas being pumped passes through the second stage, and exits through the spring loaded poppet valve 64 mounted in the end plate 62.

An important aspect of the present invention, which enhances its use as a pump for gaseous materials and for pumping gases at relatively low pressures resides in a novel oil lubrication and sealing system embodied in the present invention. As described briefly earlier, the entire pumping block 30 and rotor assembly 22 are submerged in an oil bath contained within the pump housing 36. Referring back to FIG. 2, an oil passage is provided along the linear groove or channel 54 in the mounting plate 34, or alternatively in the wear plate 56, which extends tangentially from the drive shaft opening 40. The end of the channel 54 communicates with the oil bath through a small opening 68 in the wear plate. That is, the opening 68 is beyond the edge of the pump block 30 and directly accessible to the lubricant surrounding it. The pressure differential created by the expanding pump chamber 48-1 draws oil through the small opening 68 and along the tangential channel 54 to the shaft opening 40, and from there, through the minute clearance between the rotor elements 24-1, 26-1 and the surface of the wear plate 56, into the inlet port 50-1 and from there into the pumping chamber. This small quantity of oil coats the contacting surfaces of the inner rotor and outer rotor and seals the minute clearances between them to reduce leakage of gas therebetween and permit more efficient and lower pressure levels to be achieved. Moving in the same general direction as gas flow, the oil moves from inlet 50-1, along the inner rotor 24-1 to the outlet 52-1 and into the second stage for lubricating and sealing there also. As the rotor turns, this oil traces a generally spiral path through each pumping stage.

In accordance with a further aspect of this oil sealing arrangement, the diameter of the drive shaft 42 is preferably substantially smaller than the minor root diameter of the inner rotors 24-1 and 24-2. This provides a relatively wide uninterrupted area which, when sealed by an oil film, helps prevent the bypass of gas between the end surface of the inner rotor and the facing surface of the end plate or rotor chamber. Substantially shorter or narrower surfaces would not provide a sufficiently wide oil film and would permit gas to bypass (sometimes referred to as "blowby" or "leakage") between the moving parts and thus impair the ability of the pump to obtain low pressure levels. Preferably the ratio of inner rotor minor root diameter to drive shaft diameter which is believed to provide the best sealing arrangement is between and includes 2/1 and 4/1.

To further enhance the seal and sealing area between adjacent pump parts in accordance with the present invention, the inlet and outlet ports are preferably located substantially between and have a width preferably less than the difference between the minor root radius of the inner rotor and the major root radius of the outer rotor ($R_o - R_i$) (FIG. 9) so as to maximize the sealing area between the drive shaft 42 and the inside peripheral edges of the ports. Further, it should be noted that in the preferred embodiment of the present invention, the inlet and outlet ports are at opposite ends of the pumping chamber which serves to increase the distance between them for improved sealing and to reduce "blowby" between the ports.

Figure 4:
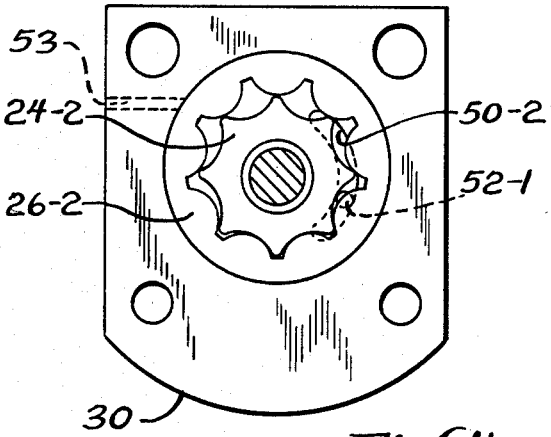
FIG. 4 is an elevational view of the assembled gerotor rotor elements, taken along line 4—4 of FIG. 2.
Figure 3:
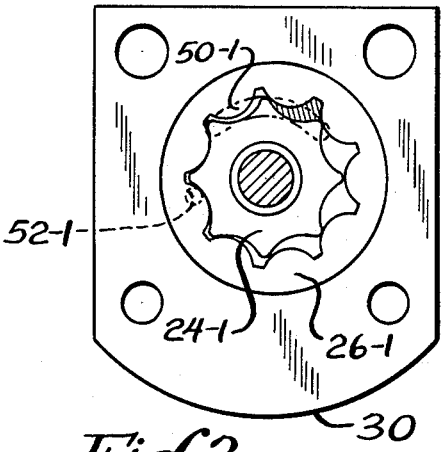
FIG. 3 is an elevational view of the assembled gerotor rotor elements, taken along line 3—3 of FIG. 2.

An auxiliary oil port 53 (FIG. 4) is provided in the second stage of the pumping block to improve lubrication and and sealing in relatively high pressure conditions, when much of the oil from the first stage is being exhausted through the intermediate by-pass valve. The oil is drawn through port 53 into the second stage by viscous drag and pressure differential created by the rotation of the outer rotor.

An alternative technique for introducing lubricating and sealing oil into the pumping chamber, is to provide a series of small depressions in the end surfaces of the inner and/or outer rotors which would communicate during rotation, with oil channeling grooves in the wear plate 56, which grooves would extend beyond the edge of the pump block to communicate with the oil bath in which the pump is immersed. Thus, as the rotors rotate, they will pick up a selected or pre-measured supply of oil as they move past the oil supply channels in the wear plate. The pockets would then discharge the oil into the pumping chamber by way of the suction created at the inlet port 50-1. When the pump is stopped, this arrangement would prevent the vacuum in the sysrem from drawing or sucking oil from the pump back into that system or source.

Figure 11:
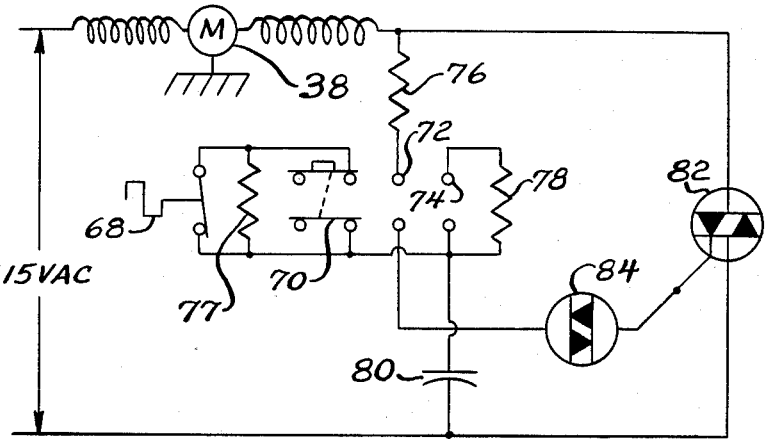
FIG. 11 is a schematic of speed control and protective circuit employed in the present invention.

The gerotor pump 20 of the present invention is preferably controlled by the multi-speed electric circuit shown in FIG. 11. A multi-speed pump switch 70 has high and low speed positions 72 and 74 for varying the pump speed. For example, high speed may be used during initial evacuation or pump down. The switch 70 varies the pump speed by connecting either one or both of resistors 76 and 78 in series with capacitor 80. The resistor-capacitor combination is in parallel with triac 82 and the diac 84, and the different charging rates of the capacitor at the switch positions 72 and 74 provide different switch-on intervals for the triac, which energizes the motor 38. As a unique protection against overheating, e.g., due to excessive high speed operating time, thermal switch 68 is connected in parallel with switch 70 and upon overheating operates to connect resistor 77 into the circuit to change the charging time constant of the circuit to shift the pump into a low speed mode for cooling.

In summary, with the features described above, a gerotor type pump, which is normally used only for pumping liquids such as hydraulic fluids, and the advantages attendant with such a pump, i.e., the low relative moving speeds between parts, durability and reliability, may be used for pumping gases at very low pressures, even at the molecular level.

Although the present invention has been described in terms of the preferred embodiment, the scope of the present invention, as set forth in the attached claims, is intended to include those equivalent structures, some of which may be immediately apparent upon reading this description and others of which may become apparent only after some study.

What is claimed is:

1. In a gerotor vacuum pump adapted for evacuating gases from a container or the like at relatively low pressure levels, wherein the gases are drawn from the container into said pump through a vacuum connection and into a pumping chamber, said pump including first and second walls defining a rotor chamber therebetween, an outer rotor having a plurality of teeth disposed on the inner axial surface thereof, an inner rotor mounted on a shaft for rotation within said outer rotor and having one less tooth on its outer axial surface than said outer rotor, the inner axial surface of said outer rotor and the outer axial surface of said inner rotor defining at least one pumping chamber which expands and contracts as said inner rotor rotates relative to said outer rotor, the improvement comprising: a gas inlet port in said first wall disposed between said vacuum connection and said pumping chamber, said gas inlet port communicating with said pumping chamber during a substantial portion of the time when said pumping chamber is expanding, a gas outlet port in said second wall axially disposed and angularly spaced from said inlet port, said gas inlet port communicating with said pumping chamber only just prior to complete contraction of the pumping chamber, and oil inlet means communicating an oil source with said gas inlet port, said oil communicating with said gas inlet port and following a generally spiral path through said pump, said oil source having a pressure greater than the pressure within said gas inlet port and said pumping chamber during operation of said pump, whereby the expansion of said pumping chamber during operation of said pump creates a pressure differential between said oil source and said gas inlet port which draws oil from said oil inlet means through said gas inlet port with said gas being evacuated from said container into said pumping chamber and coating the contacting surfaces of said inner rotor and outer rotor upon communication of said gas inlet port with said pumping chamber to provide an oil coating between said contacting surfaces so as to seal the gas in said pumping chamber during the expansion and contraction of said pumping chamber and permit the pumping of relatively low pressure levels, the inner rotor minor root diameter being sufficiently larger than the diameter of said shaft to provide a relatively wide uninterrupted area which receives an oil film during operation of the pump which thereby effectively minimizes bypass of gas between an endface of said inner rotor and a surface of the first wall adjacent thereto.

2. A pump in accordance with claim 1, wherein the ratio of root diameter of said inner rotor to the shaft diameter is at least 2:1.

3. A pump in accordance with claim 1, wherein the ratio of root diameter of said inner rotor to the shaft diameter is from approximately 2:1 to 4:1.

4. A pump in accordance with claim 1, wherein the leading edge of said gas inlet port is angularly spaced from 5° to 38° from the nearest edge of said gas outlet port.

5. A pump in accordance with claim 1, wherein the gas inlet port spans an angle which is greater than the angle between adjacent teeth of said inner rotor.

6. A pump in accordance with claim 1, wherein said gas outlet port spans an angle which is less than the angle between adjacent teeth of said inner rotor.

7. A pump in accordance with claim 1, comprising a pair of rotor chambers, said outlet port of one of said chambers communicating with the inlet port of the other of said chambers, and the outlet of said other of said chambers communicates with the ambient atmosphere.

8. A pump in accordance with claim 1, further comprising a spring biased valve normally closing said outlet port.

9. A pump in accordance with claim 1, further comprising an electric motor for turning said rotor gear, and control means for deenergizing said motor when a selected amount of gas is pumped.

10. A pump in accordance with claim 9, wherein said control means includes a temperature sensing element disposed to control operation of said motor.

11. A gerotor vacuum pump adapted for evacuating gases from a container or the like at relatively low pressure levels comprising:

first and second walls defining a cylindrical rotor chamber therebetween;

an outer rotor having a plurality of teeth disposed on the inner axial surface thereof;

an inner rotor mounted on a shaft for rotation within said outer rotor, and having one less tooth on its outer axial surface than said outer rotor, the inner axial surface of said outer rotor and the outer surface of said inner rotor defining at least one pumping chamber which expands and contracts as said inner rotor rotates relative to said outer rotor;

a vacuum connection providing a passageway for gas flow from said container to said pump;

a gas inlet port in said first wall disposed between said vacuum connection and said pumping chamber, said gas inlet port communicating with said pumping chamber during a substantial portion of the time when the pumping chamber is expanding, said gas inlet port further spanning an angle which is greater than the angle between adjacent teeth of said inner rotor;

a gas outlet port in said second wall axially disposed and angularly spaced from said inlet port, said gas inlet port communicating with said pumping chamber only just prior to complete contraction of the chamber, said gas outlet port further spanning an angle which is less than the angle between adjacent tooth divisions of said inner rotor, whereby gas flowing through said pump follows a spiral path between said inlet and said outlet as said rotor turns; and oil inlet means communicating an oil source with said gas inlet port, said oil source having a pressure greater than the pressure within said gas inlet port and said pumping chamber during operation of said pump, whereby the expansion of said pumping chamber during operation of said pump creates a pressure differential between said oil source and said gas inlet port which draws oil from said oil inlet means through said gas inlet port with said gas being evacuated from said container into said pumping chamber and coating the contacting surfaces of said inner rotor and outer rotor upon communication of said gas inlet port with said pumping chamber to provide an oil coating between said contacting surfaces so as to seal the gas in said pumping chamber during the expansion and contraction of said pumping chamber and permit the pumping of relatively low pressure levels, the inner rotor minor root diameter being sufficiently larger than the diameter of said shaft to provide a relatively wide uninterrupted area which receives an oil film during operation of the pump which thereby effectively minimizes bypass of said gas between an endface of said inner rotor and a surface of the first wall adjacent thereto.

12. A pump in accordance with claim 11, wherein the ratio of root diameter of said inner rotor to the axial shaft diameter is at least 2:1.

13. A pump in accordance with claim 11, wherein the rotor of root diameter of said inner rotor to the shaft diameter is from approximately 2:1 to 4:1.

14. A pump in accordance with claim 11, wherein the leading edge of said gas inlet port is angularly spaced from 5° to 38° from the nearest edge of said gas outlet port.

15. A pump in accordance with claim 11, comprising a pair of rotor chambers, said outlet port of one of said chambers communicating with the inlet port of the other of said chambers, and the outlet of said other of said chambers communicates with the ambient atmosphere.

16. A pump in accordance with claim 11, further comprising a spring biased valve normally closing said outlet port.

17. A pump in accordance with claim 11, further comprising an electric motor for turning said rotor gear, and control means for deenergizing said motor when a selected amount of gas is pumped.

18. A pump in accordance with claim 17, wherein said control means includes a temperature sensing element disposed to control operation of said motor.

* * * * *

UNITED STATES PATENT AND TRADEMARK OFFICE

CERTIFICATE OF CORRECTION

PATENT NO. : 4,519,755

DATED : May 28, 1985

INVENTOR(S) : David E. Hanson

It is certified that error appears in the above—identified patent and that said Letters Patent is hereby corrected as shown below:

Column 5, line 12, "our" should read --out--.
Column 5, line 62, "ro" should read --to--.
Column 7, line 37, delete "and" after "lubrication and".

Signed and Sealed this

*Eleventh* Day of *March 1986*

[SEAL]

*Attest:*

DONALD J. QUIGG

*Attesting Officer*

*Commissioner of Patents and Trademarks*